US008959841B1

(12) United States Patent
Reese

(10) Patent No.: US 8,959,841 B1
(45) Date of Patent: Feb. 24, 2015

(54) GUTTER PROTECTOR DEBRIS FENCE

(71) Applicant: Douglas R. Reese, Woodstock, GA (US)

(72) Inventor: Douglas R. Reese, Woodstock, GA (US)

( * ) Notice: Subject to any disclaimer, the term of this patent is extended or adjusted under 35 U.S.C. 154(b) by 0 days.

(21) Appl. No.: 14/171,730

(22) Filed: Feb. 3, 2014

(51) Int. Cl.
*E04D 13/00* (2006.01)
*E04D 13/076* (2006.01)

(52) U.S. Cl.
CPC ..... *E04D 13/076* (2013.01)
USPC ..... 52/12

(58) Field of Classification Search
CPC ..... E04D 13/076; E04D 13/0725
USPC ..... 52/12
See application file for complete search history.

(56) References Cited

U.S. PATENT DOCUMENTS

| | | | | |
|---|---|---|---|---|
| 2,209,741 | A | 7/1940 | Sullivan et al. | |
| 3,741,398 | A | 6/1973 | Abramson | |
| 4,644,704 | A | 2/1987 | Pedgonay | |
| 4,750,300 | A | 6/1988 | Winger, Jr. | |
| 4,841,686 | A | 6/1989 | Rees | |
| 4,907,381 | A | 3/1990 | Ealer | |
| 4,959,932 | A | 10/1990 | Pfeifer | |
| 5,072,551 | A * | 12/1991 | Manoogian, Jr. | 52/12 |
| 5,095,666 | A | 3/1992 | Williams, Jr. | |
| 5,109,640 | A | 5/1992 | Creson | |
| 5,271,192 | A | 12/1993 | Nothum, Sr. et al. | |
| 5,388,377 | A | 2/1995 | Faulkner | |
| 5,406,754 | A | 4/1995 | Cosby | |
| 5,438,803 | A | 8/1995 | Blizsard, Jr. | |
| 5,555,680 | A | 9/1996 | Sweers | |
| 5,619,825 | A | 4/1997 | Leroney et al. | |
| 5,813,173 | A | 9/1998 | Way, Sr. | |
| 5,842,311 | A | 12/1998 | Morin | |
| 5,893,240 | A | 4/1999 | Ealer, Sr. | |
| 5,956,904 | A | 9/1999 | Gentry | |
| 6,016,631 | A | 1/2000 | Iowrie, III | |
| 6,412,228 | B1 | 7/2002 | Meckstroth | |
| 6,463,700 | B2 | 10/2002 | Davis | |
| 6,951,077 | B1 | 10/2005 | Higginbotham | |
| 7,627,991 | B1 | 12/2009 | Feldhaus | |
| 7,913,458 | B2 | 3/2011 | Higginbotham | |
| 8,006,438 | B2 | 8/2011 | Higginbotham | |
| 2007/0094940 | A1 * | 5/2007 | Pijanowski | 52/12 |
| 2009/0019786 | A1 * | 1/2009 | Bachman | 52/12 |

* cited by examiner

*Primary Examiner* — Brian Glessner
*Assistant Examiner* — Brian D Mattei
(74) *Attorney, Agent, or Firm* — Crose Law LLC; Bradley D. Crose

(57) ABSTRACT

A gutter debris deterrence device is disclosed having a multiplicity of fins, each fin longitudinally coupled one to another in a generally parallel manner to define a debris fence collectively and configured for insertion into a roof rain gutter protection system. The gutter debris deterrence device, upon insertion into a gutter protection system, provides improved debris deterrence as water and debris round a gutter protector cover for entry into a gutter and hit the gutter debris deterrence device thereby preventing entry of the debris into the gutter. The device can include a spine disposed longitudinally to provide structural support and rigidity. The device can include a coupling channel disposed longitudinally generally parallel to the spine and configured to couple to an upper portion of a front wall of a gutter.

18 Claims, 12 Drawing Sheets

GUTTER PROTECTOR DEBRIS FENCE

FIELD OF THE INVENTION

The technology described herein relates generally to gutters for roofs and other structures, as well as covers, screens, protection systems, guards, debris eliminators, screen guards, debris shields, and the like, to be mounted upon such gutters. More specifically, this technology relates to a gutter protector debris fence for use on a gutter protection system to provide a barrier to entry to block debris and the like from entry into a gutter as water flows over a gutter protector cover and into the gutter.

BACKGROUND OF THE INVENTION

Rain gutters are well-known structures found along roof eaves for diverting rainwater runoff. Such gutters are open and are known to become clogged because of debris accumulation over time. These systems are typically called liquid adhesion or reverse curve gutter protection systems or products. Known gutter protection solutions includes various covers, and the like, that allow for water flow to go over an edge in a rounded fashion and into the gutter. These known solutions provide additional difficulties such as, by way of example, the water flow in such solutions can still carry debris, needles, twigs, and so forth into the gutter which creates clogging. Others have attempted to overcome these deficiencies with gutter covers and other protection devices; however, these devices have been found also to have various shortcomings.

Related utility patents known in the art include the following:

U.S. Pat. No. 2,209,741, issued to Sullivan et al. on Feb. 17, 1939, discloses a roofing gutter and guard therefor.

U.S. Pat. No. 3,741,398, issued to Abramson on Jun. 26, 1973, discloses a roof gutter and protector.

U.S. Pat. No. 4,644,704, issued to Pedgonay on Feb. 24, 1987, discloses a rain gutter debris eliminator.

U.S. Pat. No. 4,750,300, issued to Winger, Jr. on Jun. 14, 1988, discloses a gutter screen guard.

U.S. Pat. No. 4,841,686 issued to Rees on Jun. 27, 1989, discloses a rain gutter assembly.

U.S. Pat. No. 4,907,318, issued to Ealer on Mar. 13, 1990, discloses a gutter screen.

U.S. Pat. No. 4,959,932, issued to Pfeifer on Oct. 2, 1990, discloses a rain gutter screen.

U.S. Pat. No. 5,072,551, issued to Manoogian, Jr. on Dec. 17, 1991, discloses a gutter guard.

U.S. Pat. No. 5,095,666, issued to Williams, Jr. on Mar. 17, 1992, discloses a device for protecting roof gutters.

U.S. Pat. No. 5,109,640, issued to Creson on May 5, 1992, discloses a screen for a rain gutter.

U.S. Pat. No. 5,271,192, issued to Nothum, Sr. et al. on Dec. 21, 1993, discloses a rain gutter screen.

U.S. Pat. No. 5,388,377, issued to Faulkner on Feb. 14, 1995, discloses a gutter assembly for roofs.

U.S. Pat. No. 5,406,754, issued to Cosby on Apr. 18, 1995, discloses a drain gutter debris guard and method of making.

U.S. Pat. No. 5,438,803, issued to Blizard, Jr. on Aug. 8, 1995, discloses a rain gutter guard.

U.S. Pat. No. 5,555,680, issued to Sweers on Sep. 17, 1996, discloses a guard screen for a rain gutter having flanges for gripping the front lip of a gutter.

U.S. Pat. No. 5,619,825, issued to Lerony et al. on Apr. 15, 1997, discloses a gutter screen.

U.S. Pat. No. 5,813,173, issued to Way, Sr. on Sep. 29, 1998, discloses a gutter protector.

U.S. Pat. No. 5,842,311, issued to Morin on Dec. 1, 1998, discloses a gutter screen of cover.

U.S. Pat. No. 5,893,240, issued to Ealer, Sr. on Apr. 13, 1999, discloses a gutter screen.

U.S. Pat. No. 5,956,904, issued to Gentry on Sep. 28, 1999, discloses a gutter debris shield.

U.S. Pat. No. 6,016,31, issued to Lowrie, III on Jan. 25, 2000, discloses rain gutter devices.

U.S. Pat. No. 6,412,228, issued to Meckstroth on Jul. 2, 2002, discloses a leaf and debris deflecting cover device for a rain gutter.

U.S. Pat. No. 6,463,700, issued to Davis on Oct. 15, 2002, discloses a composite gutter guard.

U.S. Pat. No. 6,951,077, issued to Higginbotham on Oct. 4, 2005, discloses a non-clogging screen.

U.S. Pat. No. 7,627,991, issued to Feldhaus on Dec. 8, 2009, discloses a gutter debris cover U.S. Pat. No. 7,913,458, issued to Higginbotham, on Mar. 29, 2011, discloses a self-cleaning gutter shield.

U.S. Pat. No. 8,006,438, issued to Higginbotham on Aug. 30, 2011, discloses a non-clogging screen.

Related non-patent literature known in the art includes the following:

Leafsout, online at http://www.leafsout.com/, discloses a gutter guard system.

SuperCleanGutterScreen, online at http://www.supercleangutterscreen.com/, discloses a gutter guard system.

LeafBlaster, online at http://www.leafblaster.com/, discloses a gutter guard system.

Mastershield, online at http://www.gutterhelmet.com/gutters/mastershield-gutter-protection.cfm, discloses a gutter guard system.

LeafFilter, online at http://www.leaffilter.com/, discloses a gutter guard

GutterGlove, online at http://www.gutterglove.com/, discloses a gutter guard system.

Diamond Back Gutter Covers, online at http://www.diamondbackguttercovers.com/, discloses a gutter guard system.

Rhino Gutter Guard, online at http://www.rhinogutterguard.com/, discloses a gutter guard system.

Leaf Solution, online at http://www.leafsolution.com/, discloses a gutter guard system.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a gutter protector debris fence for use on a gutter protection system or product to provide a barrier to entry to block debris and the like from entry into a gutter as water flows over a gutter protector cover and into the gutter trough without blocking water flow in any way or otherwise impeding water flow.

In one exemplary embodiment, the technology described herein provides a gutter protector debris fence for gutter protection and improved debris deterrence. The gutter protector debris fence includes: a plurality of fins, each fin longitudinally coupled one to another in a generally parallel manner to define, collectively, a gutter protection debris fence and configured for insertion into a roof rain gutter protection system; and a spine disposed longitudinally along the gutter protector debris fence to provide structural support and rigidity to the debris fence and to which the plurality of fins is coupled. The spine additionally serves as a locking mechanism and provides alignment and support as its locks the debris fence device in place against a gutter protector cover or like device. The debris fence, upon insertion into a gutter protection system, provides improved debris deterrence as water and debris round the gutter protector cover for entry into a gutter and hit the debris fence thereby preventing entry of the debris into the gutter, but allowing water to flow freely into the system, device, or product.

In at least one embodiment, the gutter protector debris fence also includes a coupling channel disposed longitudinally along the gutter protector debris fence and generally parallel to the spine, and to which the plurality of fins is coupled, the coupling channel configured to couple to an upper portion of a front wall of a gutter trough and to lock in place.

In at least one embodiment, the gutter protector debris fence further includes a plurality of edges, each edge defined within one of the plurality of knife blade edged fins, at an outermost portion of the debris fence relative to a gutter, and configured to couple to a gutter protector cover and to provide water separation as water rounds the gutter protector cover and hits the debris fence.

In at least one embodiment, the gutter protector debris fence is integrally formed.

In various embodiments, the gutter protector debris fence is comprised of one or more of injection molded plastic, metal, composite material, and resin.

In at least one embodiment of the gutter protector debris fence each of the plurality of fins further comprises a base end generally flat in nature and configured to couple to the coupling channel. The device is configured such that it slides easily across the trough edge of a gutter to eventually drop into the channel and thus lock in place.

In at least one embodiment of the gutter protector debris fence each of the plurality of fins further comprises a second end opposing the base end, and wherein the spine is coupled to each fin at the second end of the fin.

In at least one embodiment of the gutter protector debris fence, each of the plurality of fins further comprises a base end and a second end, both of which provide a locking mechanism with which to lock to or couple to the gutter trough or the gutter protector cover, and wherein the spine is disposed between the base end and the second end and configured for placement under a gutter protection cover such that once inserted the spine provides a stop to deter removal of the gutter protector debris fence.

In at least one embodiment of the gutter protector debris fence each of the plurality of fins further comprises a base end and a second end, and wherein an inherent tension, which in effect creates a spring tension mechanism, is formed in manufacture such that as the gutter protector debris fence is inserted into a gutter protection system, the inherent tension, which in effect creates a spring tension mechanism, provides increased structural support and provides a tension to keep the device in place and causes two locking points to be held and locked in position and allows the debris fence to compensate for narrower or more open gutters front slot opening.

In another exemplary embodiment a gutter debris deterrence device includes a plurality of fins, each fin longitudinally coupled one to another in a generally parallel manner to define a debris fence collectively and configured for insertion into a roof rain gutter protection system. The gutter debris deterrence device, upon insertion into a gutter protection system, provides improved debris deterrence as water and debris round a gutter protector cover for entry into a gutter and hit the gutter debris deterrence device thereby preventing entry of the debris into the gutter, but allows uninterrupted water flow into the gutter.

In at least one embodiment, the gutter debris deterrence device also includes a spine to provide structural support and rigidity to the gutter debris deterrence device and to which the plurality of fins is couple longitudinally along the spine and in a manner generally perpendicular to the spine.

In at least one embodiment, the gutter debris deterrence device further includes a coupling channel to which the plurality of fins is coupled, disposed longitudinally along the gutter debris deterrence device and generally parallel to the spine, and the coupling channel configured to couple to and lock over an upper portion of a front wall of a gutter.

In at least one embodiment, the gutter debris deterrence device also includes a plurality of edges, each edge defined within one of the plurality of fins, at an outermost portion of the debris fence relative to a gutter, and configured to couple to a gutter protector cover and to provide water separation and not break the water adhesion to the curved surface of the hood or gutter protector in order to maintain the liquid adhesion as water rounds the gutter protector cover and hits the debris fence. The edges are knife-life edges, not round, squared, or flat, but like the edge of a knife. Additionally, once inserted into a gutter protection system such as a gutter and gutter cover, the blade-edged ends of the fins extend further away from the gutter than the bottom channel to prevent debris from entering the gutter. The blade-edged ends of the fins help release debris out and away from entering the slot opening into the gutter. The knife-like blade-edged ends of the fins are specifically constructed as such to minimize the surface area on which any debris could try to adhere, or to stick, or to otherwise attach. As such, any debris passing by the knife-like blade-edged ends of the fins is easy deterred or released away from entering the slot opening into the gutter. This specific construction utilizing the knife-like blade-edged ends of the fins works with both one-piece gutter protection products (where the gutter and cover portions are integrally formed as one unit) and also with two-piece gutter protection products such as hooded or helmeted gutter protection products.

In at least one embodiment, the gutter debris deterrence device is integrally formed.

In various embodiments, the gutter debris deterrence device is comprised of one or more of injection molded plastic, metal, composite material, and resin.

In at least one embodiment of the gutter debris deterrence device, each of the plurality of fins further comprises a base end generally flat in nature and configured to couple to the coupling channel.

In at least one embodiment of the gutter debris deterrence device, each of the plurality of fins further comprises a second end opposing the base end, and wherein the spine is coupled to each fin at the second end of the fin.

In at least one embodiment of the gutter debris deterrence device, each of the plurality of fins further comprises a base end and a second end, and wherein the spine is disposed between the base end and the second end and configured for placement under a gutter protection cover such that once inserted the spine provides a stop and locking mechanism to lock in place and thus deter removal of the gutter debris deterrence device.

In at least one embodiment of the gutter debris deterrence device, each of the plurality of fins further comprises a base end and a second end, and wherein an inherent tension, or spring mechanism, is formed in manufacture such that as the gutter debris deterrence device is inserted into a gutter protection system, the inherent tension, or spring mechanism, provides increased structural support and provides a tension to keep the device in place. Each fin serves as a spring mechanism and provides an expansion tension producer.

In another exemplary embodiment a combined gutter protection system and debris fence includes: a gutter protector cover; a plurality of fins, each fin longitudinally coupled one to another in a generally parallel manner to define, collectively, a gutter protection debris fence and configured for insertion into a roof rain gutter protection system or gutter utilizing reverse curve or liquid adhesion technology as the means for water to enter the gutter, and each fin with a knife like blade edge; a spine disposed longitudinally along the gutter protector debris fence to provide structural support and rigidity to the debris fence; a coupling channel disposed longitudinally along the gutter protector debris fence and generally parallel to the spine and configured to couple and lock down with a spring tension to an upper portion of a front wall of a gutter; and a plurality of edges, each edge defined within one of the plurality of fins, at an outermost portion of the debris fence relative to a gutter, and configured to couple to a gutter protector cover and to provide water separation as water rounds the gutter protector cover and hits the debris fence. The debris fence, upon insertion into a gutter protection system, provides improved debris deterrence as water and debris round the gutter protector cover for entry into a gutter and hit the debris fence thereby preventing entry of the debris into the gutter.

Advantageously, the technology described herein provides a gutter protector debris fence for use on a gutter protection system or gutter utilizing reverse curve or liquid adhesion technology as the means for water to enter the gutter to provide a barrier to entry to block debris and the like from entry into a gutter as water flows over a covered one piece gutter or a gutter protector cover and into the gutter.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a gutter protector debris fence for use on a gutter protection system or like product to provide a barrier to entry to block debris and the like from entry into a gutter as water flows over a gutter protector cover and into the gutter trough without blocking water flow in any way or otherwise impeding water flow.

Referring now to the figures, a gutter protector debris fence 10 is shown. The gutter protector debris fence 10 is a debris deterrence device for gutter protection and improved debris deterrence. The gutter protector debris fence 10, upon insertion into an existing one-piece covered gutter or other hooded or covered gutter protection system, or, alternatively, simultaneously installed with an complete solution at initial install, provides improved debris deterrence as both water and debris round a gutter protector cover or hood just before entry of such into a gutter. Any debris traveling with the water flow will hit the gutter protector debris fence 10, thereby preventing entry of the debris into the gutter.

Figure 1:
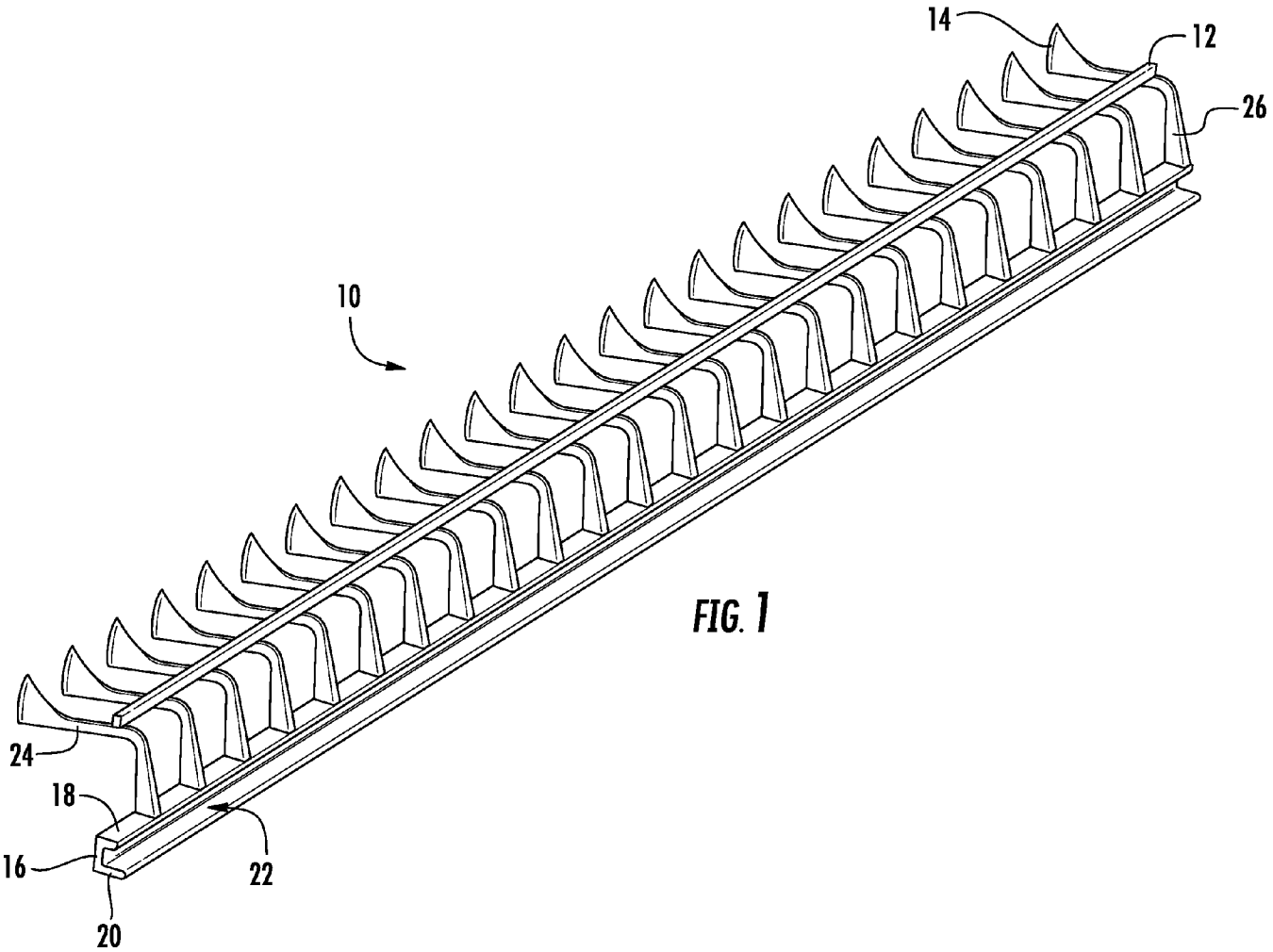
FIG. 1 is a perspective of a gutter protector debris fence, illustrating, in particular, a spine, a channel for coupling to a gutter, and a plurality of fins, according to an embodiment of the technology described herein.
Figure 2:
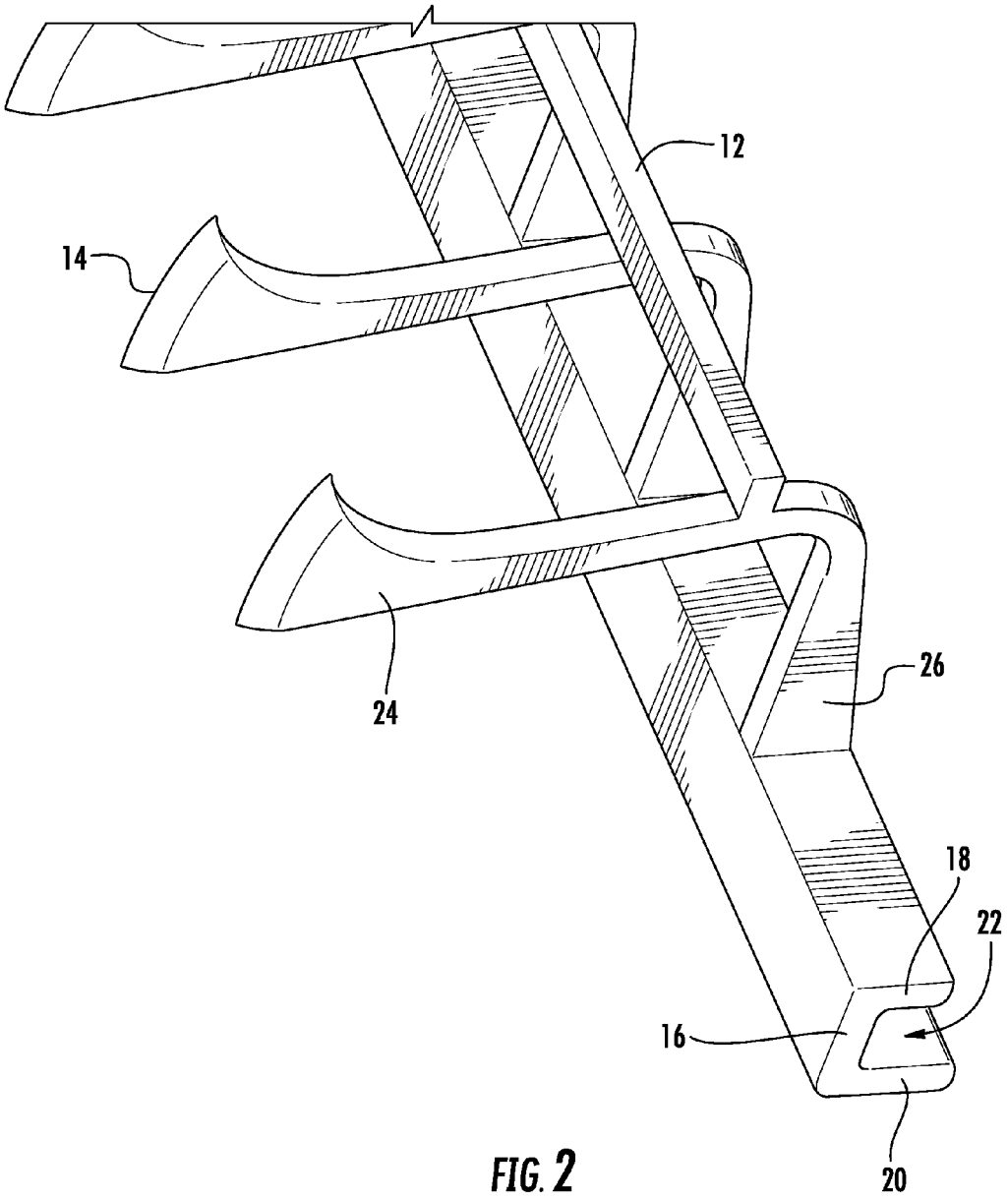
FIG. 2 is a close-up view of a section of the gutter protector debris fence depicted in FIG. 1.
Figure 3:
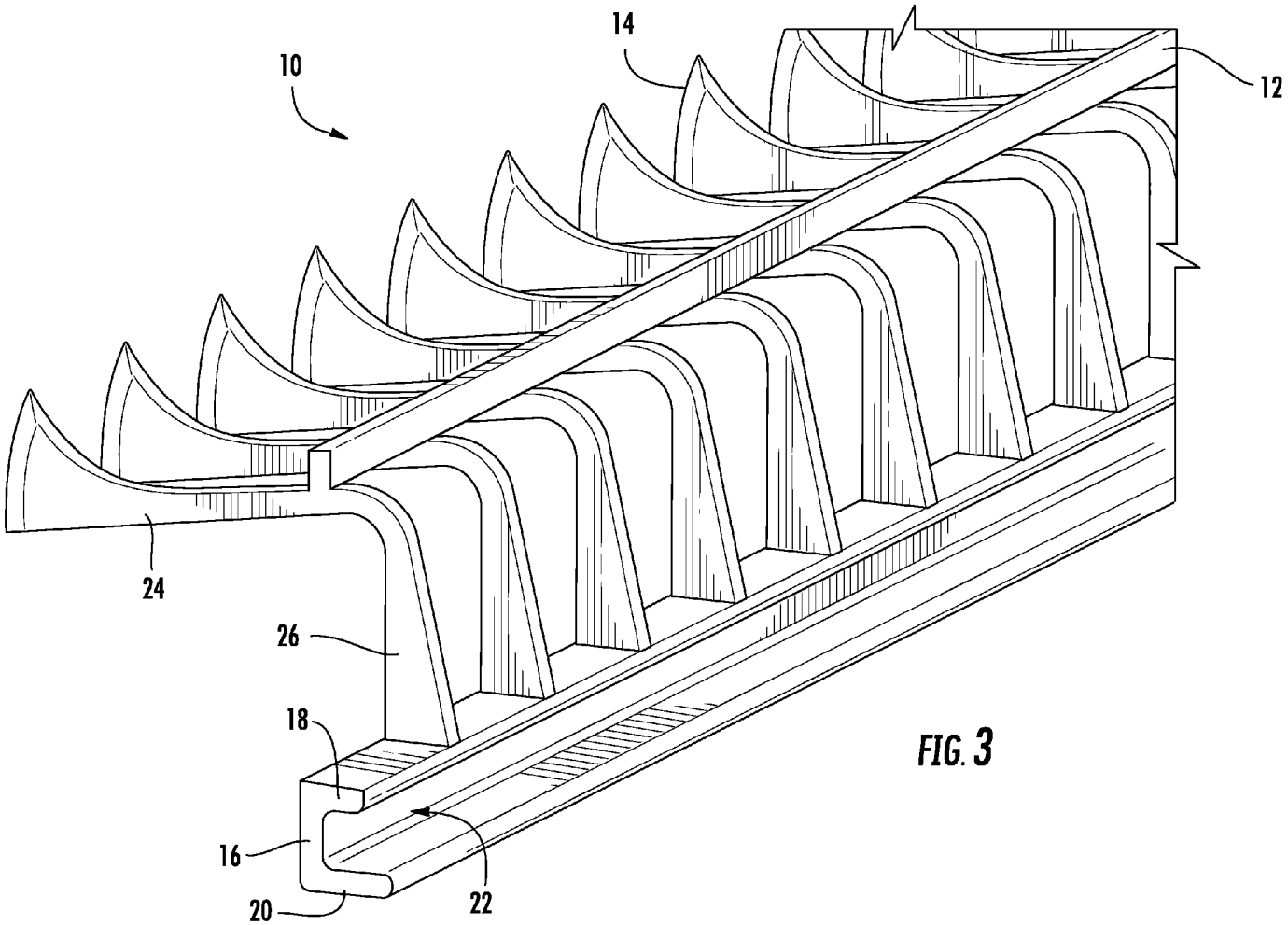
FIG. 3 is a close-up view a section of the gutter protector debris fence depicted in FIG. 1.
Figure 4:
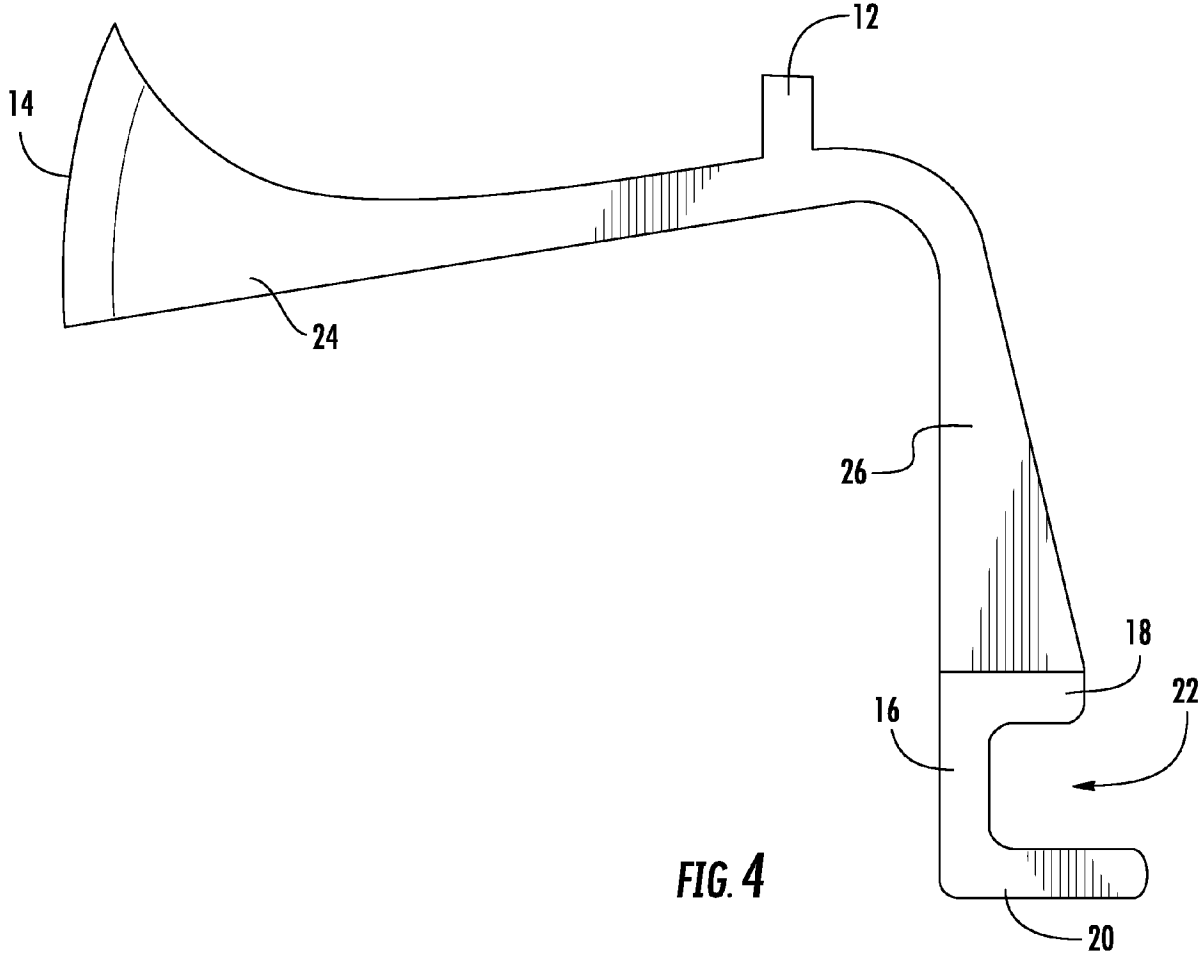
FIG. 4 is an end view of the gutter protector debris fence depicted in FIG. 1, illustrating, in particular, the spine, the channel for coupling to a gutter, and a close up of a fin edge, and a close up of the sloped edge leading to the channel, according to an embodiment of the technology described herein.
Figure 5:
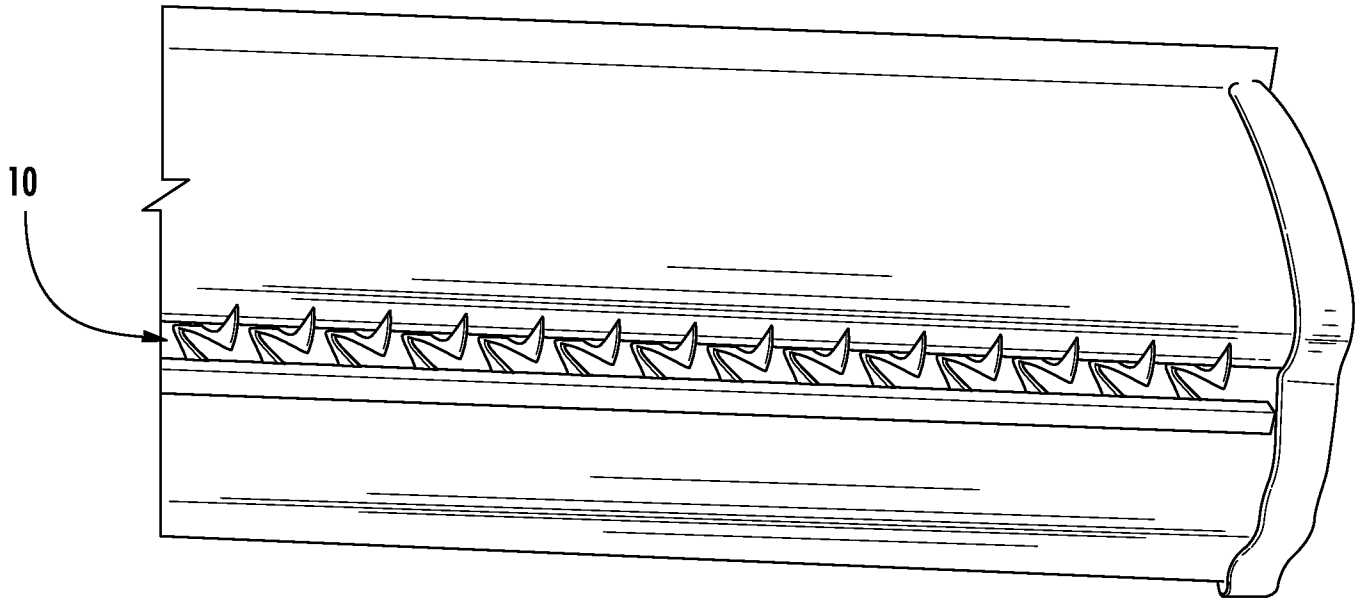
FIG. 5 is a perspective view of the gutter protector debris fence depicted in FIG. 1, illustrating, in particular, use of the debris fence in a one-piece covered gutter/gutter protection system, according to an embodiment of the technology described herein.
Figure 6:
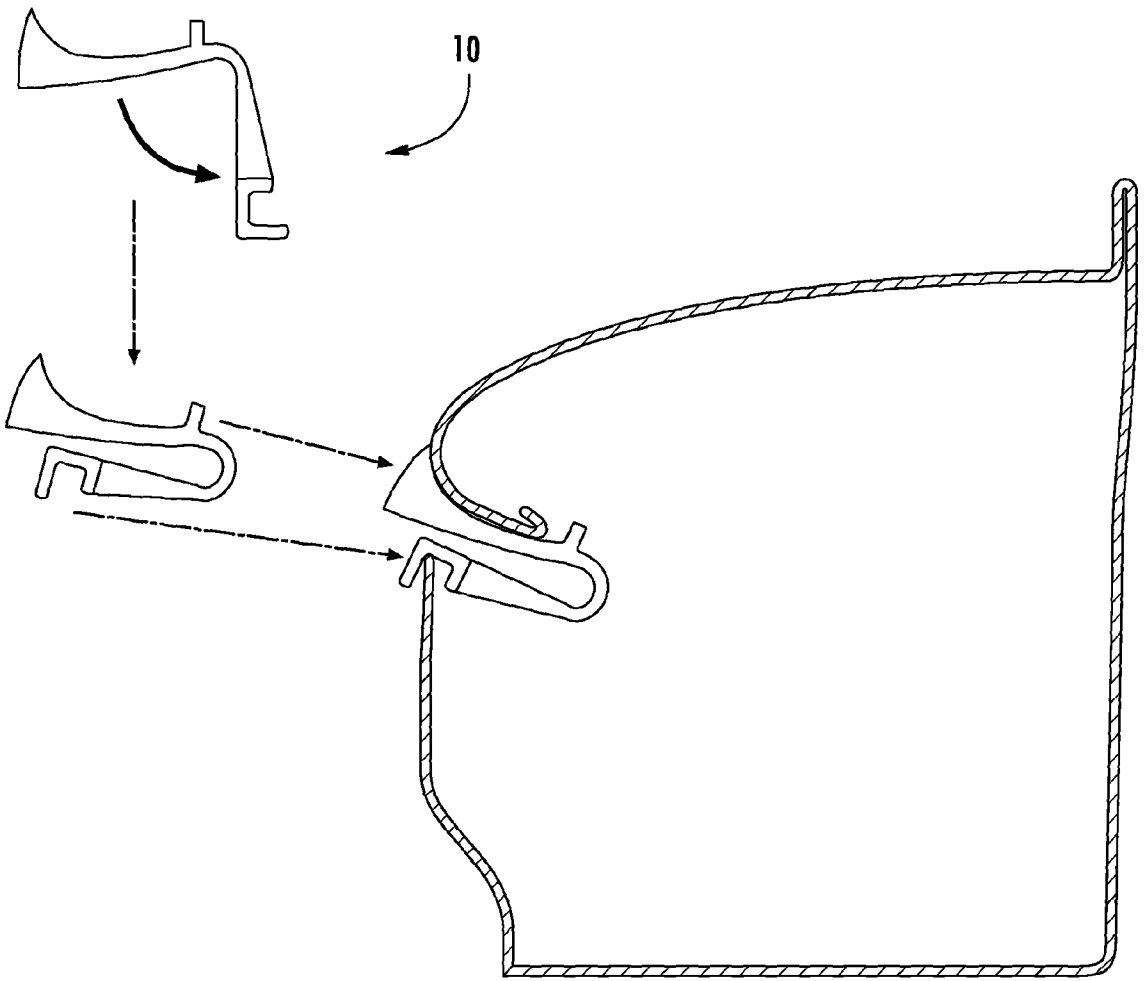
FIG. 6 is an end view of the gutter protector debris fence depicted in FIG. 1, shown with a cross-section view of the one-piece gutter protection system shown in FIG. 5, illustrating, in particular, the means by which the debris fence is configured for insertion and placement with the gutter/gutter protection system, and illustrating, in particular, the flex or spring mechanism from original form to the compressed form, and blade-edged ends of the fins extending further away from the gutter than the bottom channel to prevent debris from entering the gutter, according to an embodiment of the technology described herein.
Figure 7:
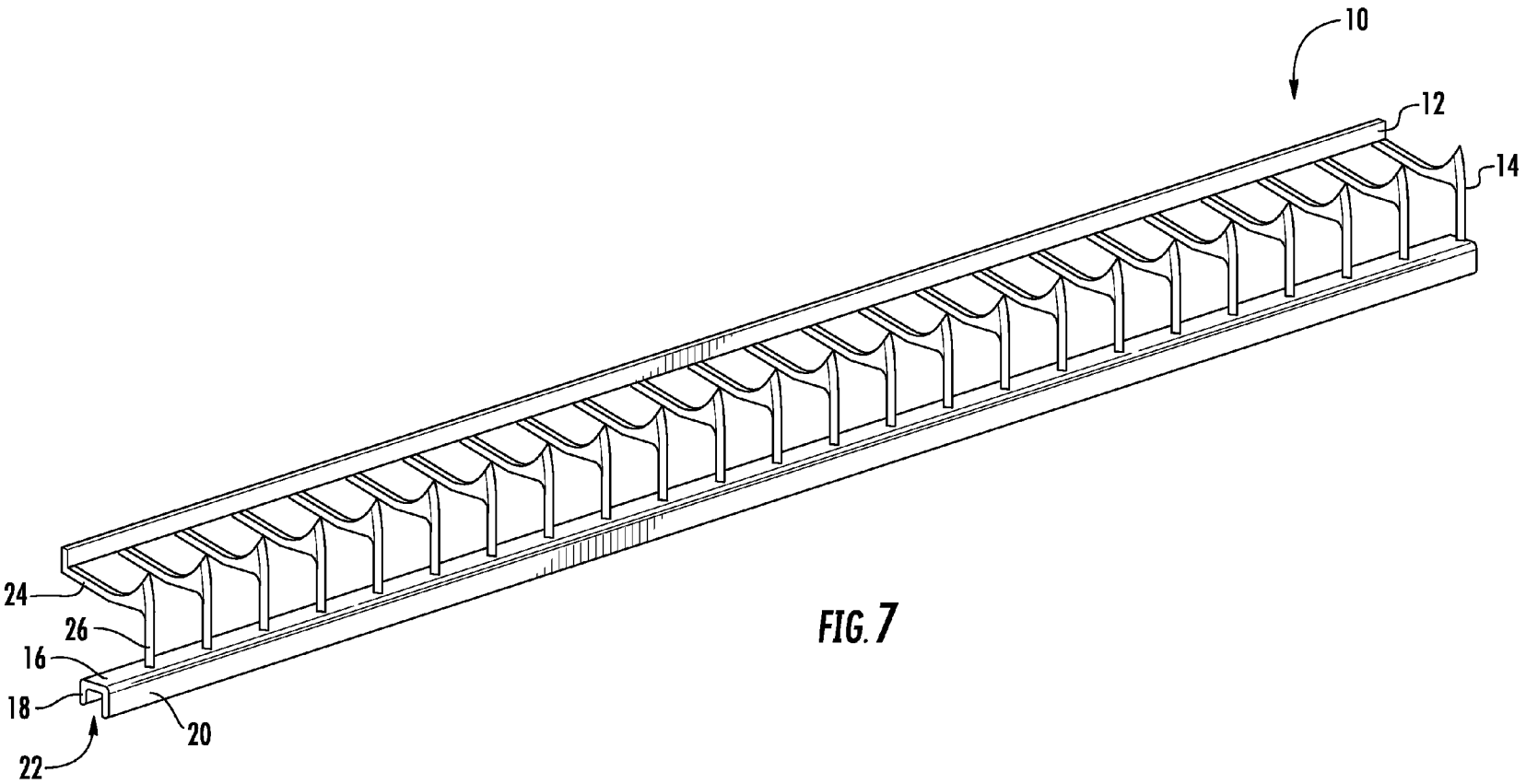
FIG. 7 is a perspective of a gutter protector debris fence, a spine, a channel for coupling to a gutter, and a plurality of fins, according to an embodiment of the technology described herein.
Figure 8:
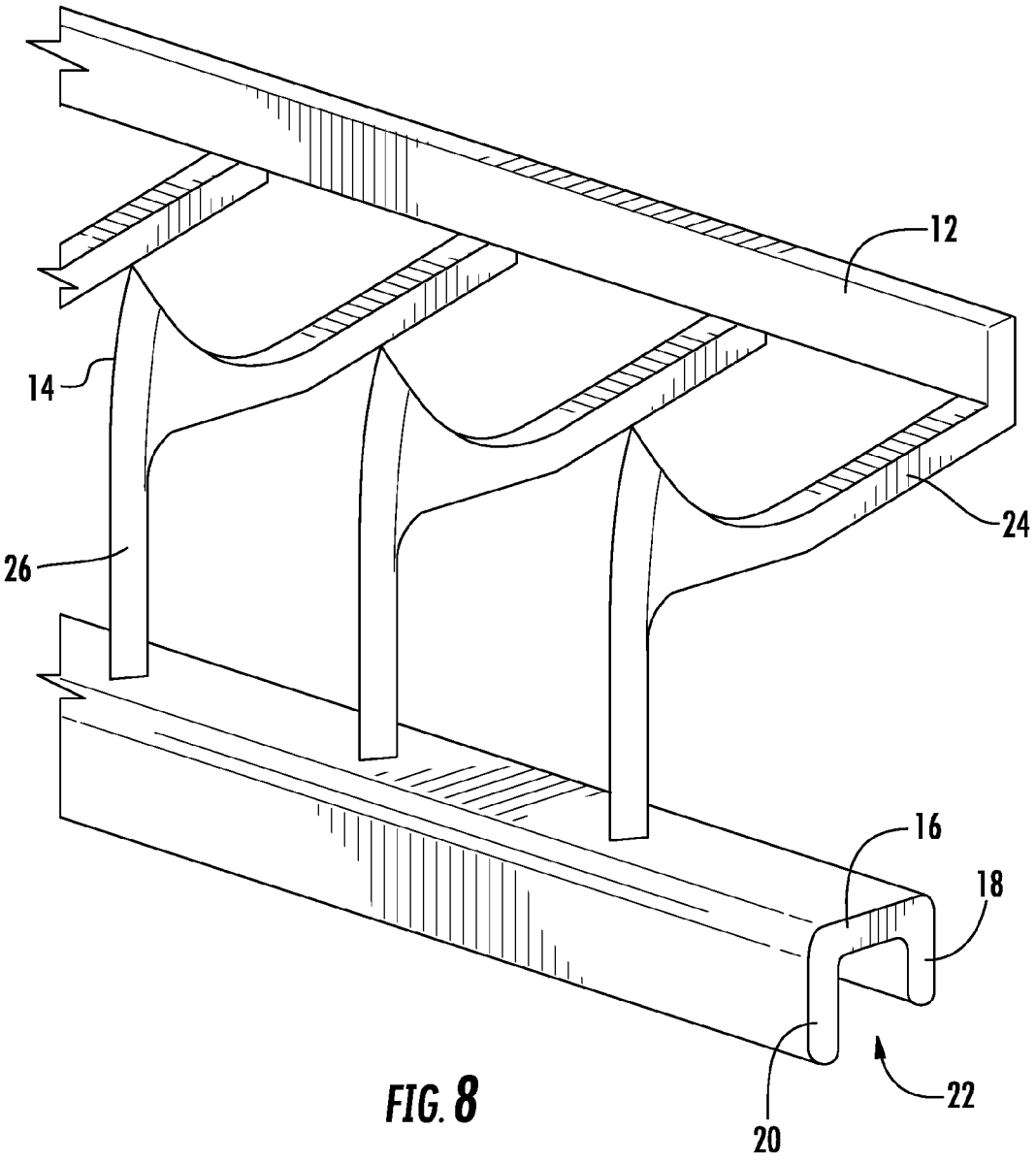
FIG. 8 is a close-up view of a section of the gutter protector debris fence depicted in FIG. 7.
Figure 9:
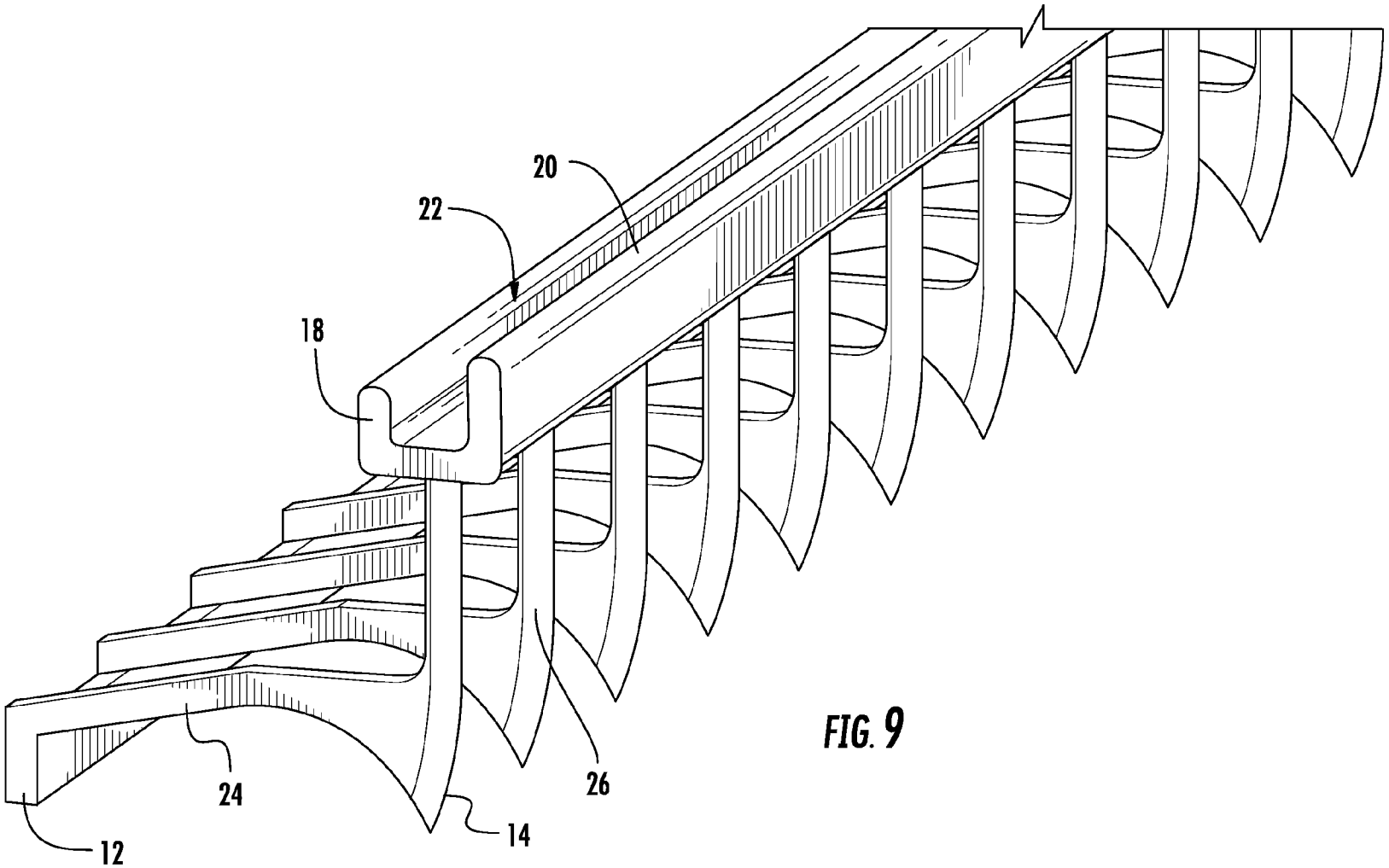
FIG. 9 is a close-up view a section of the gutter protector debris fence depicted in FIG. 7.
Figure 10:
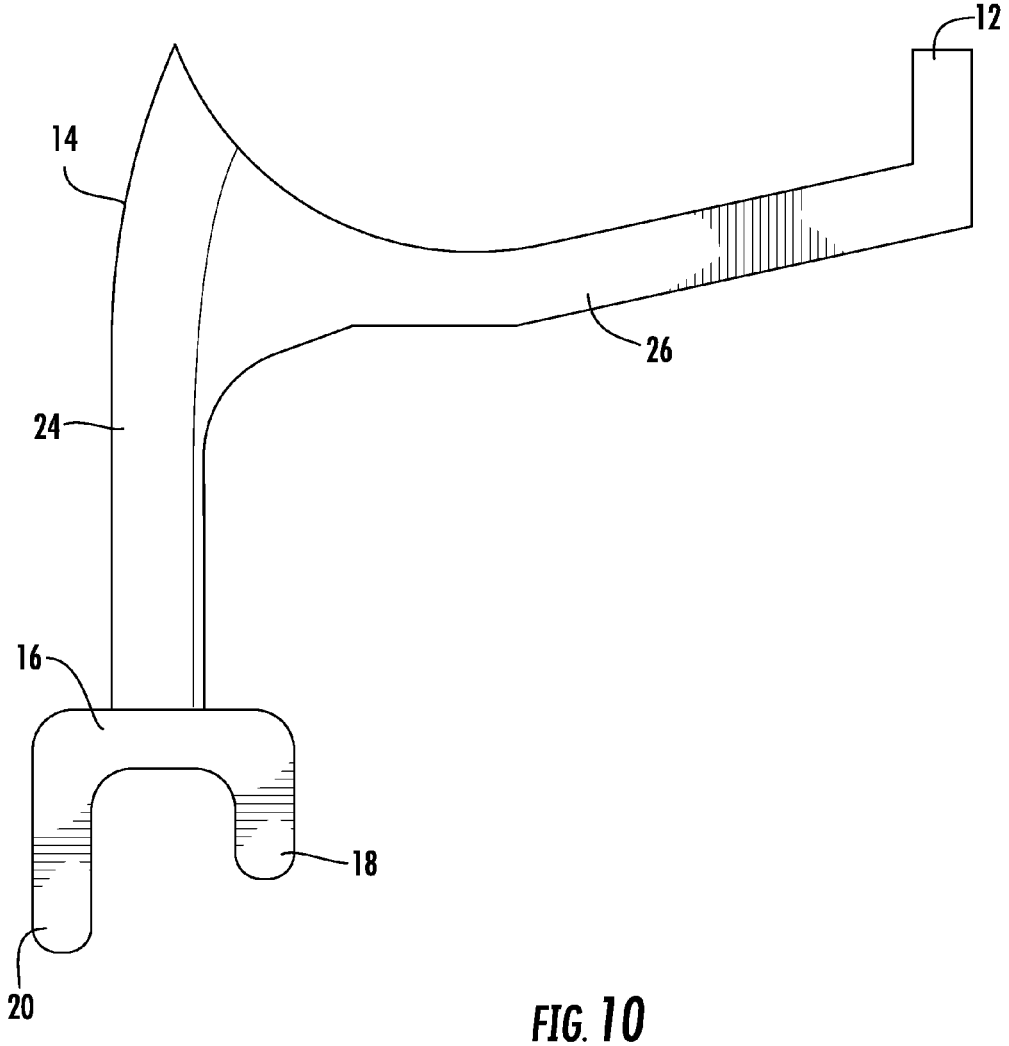
FIG. 10 is an end view of the gutter protector debris fence depicted in FIG. 7, illustrating, in particular, the spine, the channel for coupling to a gutter, and a close up of a fin edge, according to an embodiment of the technology described herein.
Figure 11:
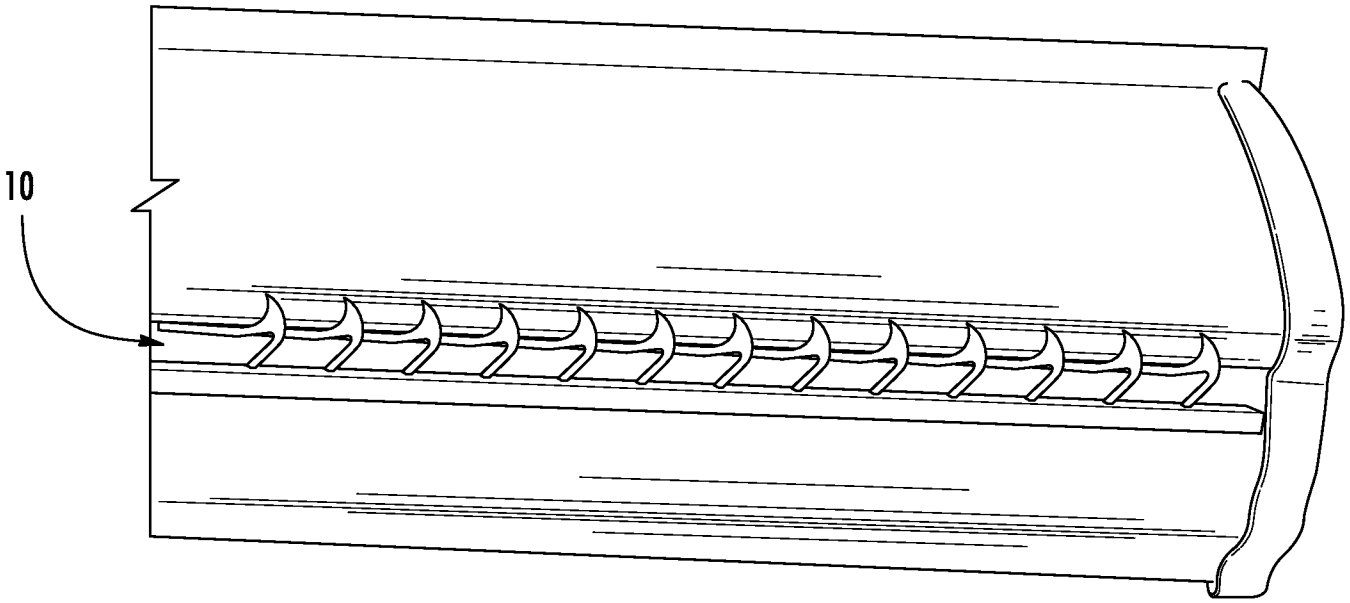
FIG. 11 is a perspective view of the gutter protector debris fence depicted in FIG. 7, illustrating, in particular, use of the debris fence in a one-piece covered gutter/gutter protection system, according to an embodiment of the technology described herein.
Figure 12:
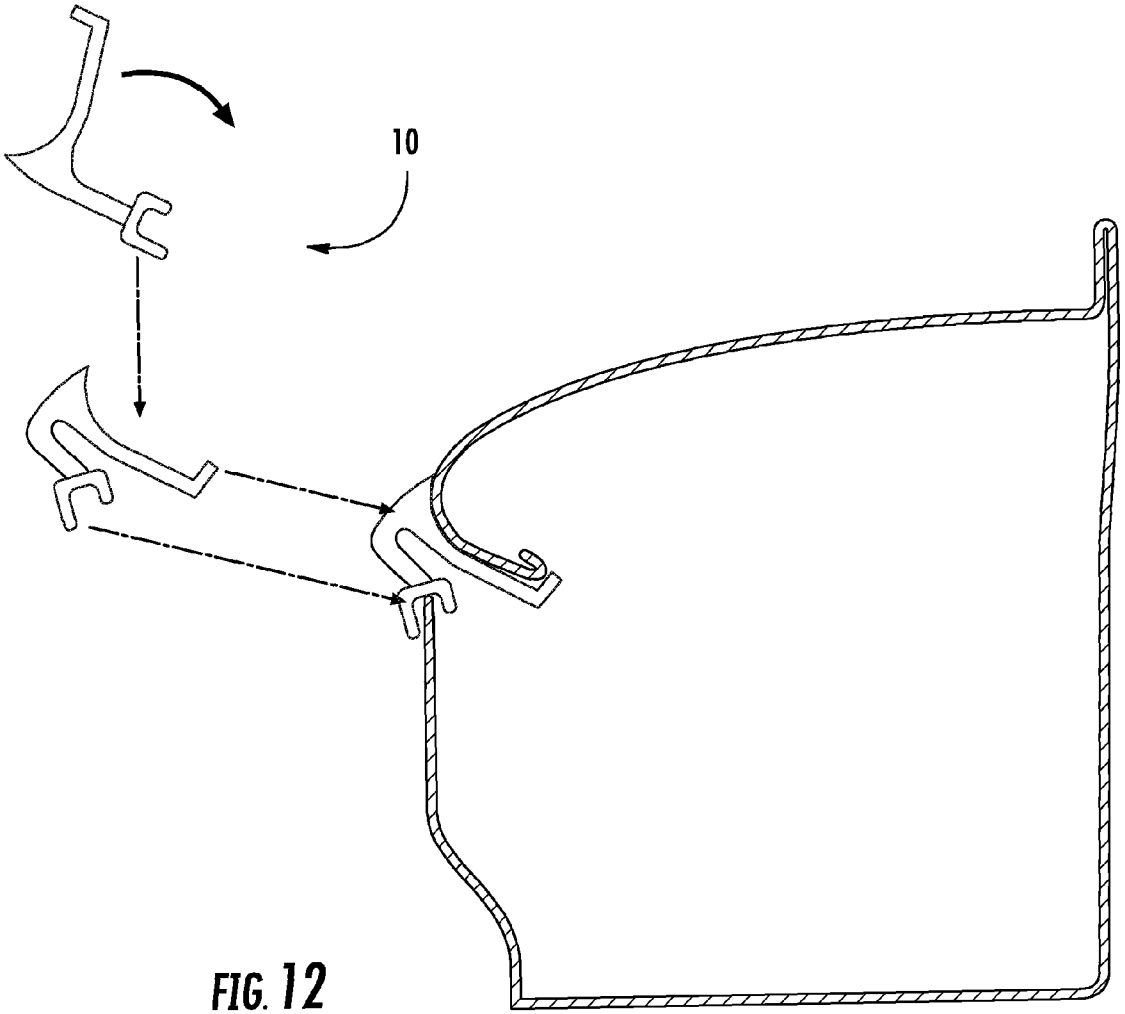
FIG. 12 is an end view of the gutter protector debris fence depicted in FIG. 7, shown with a cross-section view of the gutter protection system shown in FIG. 5, illustrating, in particular, the means by which the debris fence is configured for insertion and placement with the gutter/gutter protection system, and illustrating, in particular, the flex or spring mechanism from original form to the compressed form, according to an embodiment of the technology described herein.

The gutter protector debris fence 10 includes a multiplicity of fins 24, 26. Each fin 24, 26 of the gutter protector debris fence 10 is longitudinally coupled one to another in a generally parallel manner to define, collectively, a debris fence. The multiplicity of fins 24, 26 is configured for insertion into a roof rain gutter protection hooded or curved system or one-piece hooded or covered gutter (as best depicted in FIGS. 5, 6, 11, and 12).

In at least one embodiment of gutter protector debris fence 10, the fins 26 include a base end. This base end is generally flat in nature and is configured to couple to the coupling channel 22. The device is configured such that it slides easily across the trough edge of a gutter to eventually drip into the channel and thus lock in place. These fins 26 are tapered or sloped to an inside edge of the channel to allow the debris fence device to easily slide into the gutter slot and lock over and down onto the upper gutter trough front edge. The knife edge 14 cuts through water adhering to a cover or hood. The point of contact to the hood or cover is minimized to prevent snagging any debris as it attempts to enter into with water flow. The portion of the fin leading up to the knife edge 14 is curved such that is does not touch the underside of the hood of cover to allow to various hood curve dimensions. Additionally, once inserted, the blade-edged ends of the fins extend further away from the gutter than the bottom channel to prevent debris from entering the gutter. The blade-edged ends of the fins help release debris out and away from entering the slot opening into the gutter. The knife-like blade-edged ends of the fins are specifically constructed as such to minimize the surface area on which any debris could try to adhere, or to stick, or to otherwise attach. As such, any debris passing by the knife-like blade-edged ends of the fins is easy deterred or released away from entering the slot opening into the gutter. This specific construction utilizing the knife-like blade-edged ends of the fins works with both one-piece gutter protection products (where the gutter and cover portions are integrally formed as one unit) and also with two-piece gutter protection products such as hooded or helmeted gutter protection products.

In at least one embodiment of gutter protector debris fence 10, the fins 24 include a second end, which are opposed to the base ends of fins 26. The spine 12 is coupled to the second end of fin 24 in at least one embodiment. As such the gutter protector debris fence 10 is configured for placement under a gutter protection cover or hood such that once inserted the spine 12 provides a stop and lock via the locking mechanism to deter removal of the gutter protector debris fence 10. As needed, and as determined in installation, portions of the spine 12 may be cut in between certain intervals of fins 24, 26 to provide increased flexibility of the debris fence 10.

In at least one embodiment of gutter protector debris fence 10, the fins 26 include a base end and the fins 24 include a second end, which are opposed to the base ends of fins 26, wherein the spine 12 is disposed between the base end and the second end. As such the gutter protector debris fence 10 is configured for placement under a gutter protection cover such that once inserted the spine 12 provides a stop and lock via the locking mechanism to deter removal of the gutter protector debris fence 10.

In at least one embodiment of gutter protector debris fence 10, an inherent tension is formed between the fins 24, 26 in manufacture such that as the fins 24, 26 are pushed closer to one another and the overall gutter protector debris fence 10 is inserted into a gutter protection system, the inherent tension provides increased structural support and provides a tension or outward flex or spring to keep the device 10 in place.

The gutter protector debris fence 10 includes a spine 12. The spine 12 is disposed longitudinally along the gutter protector debris fence 10. The spine 12 provides structural support and rigidity to the debris fence. The multiplicity of fins 24, 26 is coupled to the spine 12. The spine additionally serves as a locking mechanism and provides alignment and support as its locks the debris fence device in place against a gutter protector cover or like device. As needed, and as determined in installation, portions of the spine 12 may be cut in between certain intervals of fins 24, 26 to provide increased flexibility of the debris fence 10.

The gutter protector debris fence 10 includes a coupling channel 22. The coupling channel 22 is disposed longitudinally along the gutter protector debris fence 10 and also lies generally parallel to the spine 12. The multiplicity of fins 24, 26 is also coupled to the coupling channel 22, in addition to the spine 12.

The coupling channel 22 is configured to couple and lock down to an upper portion of a front wall of a gutter. By way of example, coupling channel 22 is shown in both FIGS. 6 and 12 as coupled to an upper portion of a front wall of a gutter.

By way of example, and in at least one embodiment, the coupling channel 22 includes a base 16, a first side 18, and a second side 20. The first side 18 and the second side 20 extending outwardly from the base 16 in a perpendicular manner, thus forming the channel 22 within the space between. The fin end closest to the channel is sloped to allow it to slide in easily into the slot as installed and then drop into and lock place. Additionally, once inserted, the blade-edged ends of the fins extend further away from the gutter than the bottom channel to prevent debris from entering the gutter. This is shown, for example, in FIG. 6. The blade-edged ends of the fins help release debris out and away from entering the slot opening into the gutter. The knife-like blade-edged ends of the fins are specifically constructed as such to minimize the surface area on which any debris could try to adhere, or to stick, or to otherwise attach. As such, any debris passing by the knife-like blade-edged ends of the fins is easy deterred or released away from entering the slot opening into the gutter. This specific construction utilizing the knife-like blade-edged ends of the fins works with both one-piece gutter protection products (where the gutter and cover portions are integrally formed as one unit) and also with two-piece gutter protection products such as hooded or helmeted gutter protection products.

The gutter protector debris fence 10 includes a multiplicity of edges 14. Each edge 14 is defined within one end of the multiplicity of fins 24, 26. Once installed, the edge 14 is located at an outermost portion of the debris fence 10 relative to a gutter. Each edge 14 is configured to couple to a gutter protector cover or hood and to provide water separation as water rounds the gutter protector cover and hits the debris fence 10. The edge 14 on each fin 24, 26 serves like a knife blade to separate water flow to each side of the fins 24, 26.

In at least one embodiment of the gutter protector debris fence 10, the debris fence 10 is integrally formed. By way of example only, the debris fence 10 can be manufactured of single-piece injection molded plastic, metal, composite material, resin, and the like.

In use for manufacture, commercialization, and so forth, the gutter protector debris fence 10 can be made as an add-on, after-market product to be added to existing gutter protection devices or as a one piece covered gutter or as a two piece covered gutter. However, the gutter protector debris fence 10 is configured such that it may be installed into an existing gutter protection device that is already installed, or alternatively, sold or purchased with an existing gutter protection device that is yet to be installed. Furthermore, the gutter protector debris fence 10 can be manufactured and commercialized with sales and purchases as a complete standalone solution, including versions as a complete gutter protection system, and in versions as a complete gutter system including other gutter components beyond what is included in only a gutter protection system.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A gutter protector debris fence for gutter protection and improved debris deterrence, the gutter protector debris fence comprising:

a plurality of fins, each fin longitudinally coupled one to another in a generally parallel manner to define, collectively, a gutter protection debris fence and configured for insertion into a roof rain gutter protection system or one or two piece covered gutter; and a spine disposed longitudinally along the gutter protector debris fence to provide structural support, rigidity, and a locking mechanism to the debris fence and to which the plurality of fins is coupled, wherein once inserted the spine provides a stop and lock via the locking mechanism to deter removal of the utter protector debris fence;

wherein the debris fence, upon insertion into a gutter protection system, provides improved debris deterrence as water and debris round the gutter protector cover for entry into a gutter and hit the debris fence thereby preventing entry of the debris into the gutter;

wherein an inherent tension or spring mechanism is formed in manufacture such that as the gutter protector debris fence is inserted into a gutter protection system, the inherent tension provides increased structural support and provides an outward tension to keep the device in place; and a plurality of edges, each edge defined as a knife edge within one of the plurality of fins, at an outermost portion of the debris fence relative to a gutter, and configured to couple to a gutter protector cover and to provide water separation as water rounds the gutter protector cover and hits the debris fence, wherein each knife edged fin is configured to cut through water adhering to a hood or cover without breaking the water adhesion properties performed by the hood or the cover.

2. The gutter protector debris fence of claim 1, further comprising:

a coupling channel disposed longitudinally along the gutter protector debris fence and generally parallel to the spine, and to which the plurality of fins is coupled, the coupling channel configured to couple to and lock down on an upper portion of a front wall of a gutter trough.

3. The gutter protector debris fence of claim 2, wherein each of the plurality of fins further comprises a base end generally flat in nature and configured to couple to the coupling channel.

4. The gutter protector debris fence of claim 3, wherein each of the plurality of fins further comprises a second end opposing the base end, and wherein the spine is coupled to each fin at the second end of the fin.

5. The gutter protector debris fence of claim 1, wherein the debris fence is integrally formed.

6. The gutter protector debris fence of claim 1, wherein the debris fence is comprised of one or more of injection molded plastic, metal, composite material, and resin.

7. The gutter protector debris fence of claim 1, wherein each of the plurality of fins further comprises a base end and a second end, and wherein the spine is disposed between the base end and the second end and configured for placement under a gutter protection cover such that once inserted the spine provides a stop to deter removal of the gutter protector debris fence.

8. The gutter protector debris fence of claim 1, wherein each of the plurality of fins further comprises a base end and a second end.

9. A gutter debris deterrence device comprising:

a plurality of fins, each fin longitudinally coupled one to another in a generally parallel manner to define a debris fence collectively and configured for insertion into a roof rain gutter protection system;

wherein the gutter debris deterrence device, upon insertion into a gutter protection system, provides improved debris deterrence as water and debris round a gutter protector cover for entry into a gutter and hit the gutter debris deterrence device thereby preventing entry of the debris into the gutter;

wherein an inherent tension or spring mechanism is formed in manufacture such that as the gutter protector debris fence is inserted into a gutter protection system, the inherent tension provides increased structural support and provides an outward tension to keep the device in place; and a plurality of edges, each edge defined as a knife edge within one of the plurality of fins, at an outermost portion of the debris fence relative to a gutter, and configured to couple to a gutter protector cover and to provide water separation as water rounds the gutter protector cover and hits the debris fence, wherein each knife edged fin is configured to cut through water adhering to a hood or cover without breaking the water adhesion properties performed by the hood or the cover.

10. The gutter debris deterrence device of claim 9, further comprising:

a spine to provide structural support and rigidity to the gutter debris deterrence device and to which the plurality of fins is couple longitudinally along the spine and in a manner generally perpendicular to the spine.

11. The gutter debris deterrence device of claim 10, further comprising:

a coupling channel to which the plurality of fins is coupled, disposed longitudinally along the gutter debris deterrence device and generally parallel to the spine, and the coupling channel configured to couple and lock down to an upper portion of a front wall of a gutter.

12. The gutter debris deterrence device of claim 11, wherein each of the plurality of fins further comprises a base end generally flat in nature and configured to couple to the coupling channel.

13. The gutter debris deterrence device of claim 10, wherein each of the plurality of fins further comprises a second end opposing the base end, and wherein the spine is coupled to each fin at the second end of the fin.

14. The gutter debris deterrence device of claim 10, wherein each of the plurality of fins further comprises a base end and a second end, and wherein the spine is disposed between the base end and the second end and configured for placement under a gutter protection cover such that once inserted the spine provides a stop to deter removal of the gutter debris deterrence device.

15. The gutter debris deterrence device of claim 10, wherein each of the plurality of fins further comprises a base end and a second end.

16. The gutter debris deterrence device of claim 9, wherein the gutter debris deterrence device is integrally formed.

17. The gutter debris deterrence device of claim 9, wherein the gutter debris deterrence device is comprised of injection molded plastic.

18. A combined gutter protection system and debris fence, the system comprising:

a gutter protector cover;

a plurality of fins, each fin longitudinally coupled one to another in a generally parallel manner to define, collectively, a gutter protection debris fence and configured for insertion into a roof rain gutter protection system;

a spine disposed longitudinally along the gutter protector debris fence to provide structural support, rigidity, and a locking mechanism to the debris fence and to which the plurality of fins is coupled, wherein once inserted the spine provides a stop and lock via the locking mechanism to deter removal of the utter protector debris fence;

a coupling channel disposed longitudinally along the gutter protector debris fence and generally parallel to the spine and configured to couple to an upper portion of a front wall of a gutter; and a plurality of edges, each edge defined within one of the plurality of fins, at an outermost portion of the debris fence relative to a gutter, and configured to couple to a gutter protector cover and to provide water separation as water rounds the gutter protector cover and hits the debris fence;

wherein the debris fence, upon insertion into a gutter protection system, provides improved debris deterrence as water and debris round the gutter protector cover for entry into a gutter and hit the debris fence thereby preventing entry of the debris into the gutter;

wherein an inherent tension or spring mechanism is formed in manufacture such that as the gutter protector debris fence is inserted into a gutter protection system, the inherent tension provides increased structural support and provides an outward tension to keep the device in place; and a plurality of edges, each edge defined as a knife edge within one of the plurality of fins, at an outermost portion of the debris fence relative to a gutter, and configured to couple to a gutter protector cover and to provide water separation as water rounds the gutter protector cover and hits the debris fence, wherein each knife edged fin is configured to cut through water adhering to a hood or cover without breaking the water adhesion properties performed by the hood or the cover.

* * * * *